US005952990A

United States Patent [19]

Inoue et al.

[11] Patent Number: 5,952,990

[45] Date of Patent: Sep. 14, 1999

[54] DISPLAY DEVICE WITH POWER-OFF DELAY CIRCUITRY

[75] Inventors: Hiroshi Inoue, Yokohama; Hideo Kanno, Kawasaki; Hiroshi Netsu, Funabashi; Atsushi Mizutome, Hayama-machi, all of Japan

[73] Assignee: Canon Kabushiki Kaisha, Tokyo, Japan

[21] Appl. No.: 08/016,314

[22] Filed: Feb. 11, 1993

Related U.S. Application Data

[62] Division of application No. 07/657,259, Feb. 19, 1991, which is a continuation of application No. 07/333,956, Apr. 6, 1989, abandoned, which is a continuation of application No. 07/085,017, Aug. 13, 1987, abandoned.

[30] Foreign Application Priority Data

| | | | |
|---|---|---|---|
| Aug. 18, 1986 | [JP] | Japan | 61-192572 |
| Sep. 3, 1986 | [JP] | Japan | 61-207326 |
| Sep. 3, 1986 | [JP] | Japan | 61-207327 |
| Sep. 8, 1986 | [JP] | Japan | 61-212184 |
| Jan. 8, 1987 | [JP] | Japan | 62-002671 |

[51] Int. Cl.[6] ..... G09G 3/36

[52] U.S. Cl. ..... 345/97; 345/214

[58] Field of Search ..... 340/784, 811, 340/805; 345/97, 85, 214, 211, 212

[56] References Cited

U.S. PATENT DOCUMENTS

| | | | |
|---|---|---|---|
| 4,050,064 | 9/1977 | Hashimoto et al. | 340/324 M |
| 4,074,256 | 2/1978 | Sekiya et al. | 340/811 |
| 4,099,073 | 7/1978 | Hashimoto et al. | 307/296 R |
| 4,099,247 | 7/1978 | Mikada et al. | 340/811 |
| 4,158,786 | 6/1979 | Hirasawa | 307/296 R |
| 4,246,579 | 1/1981 | Wiesner | 340/784 |
| 4,317,115 | 2/1982 | Kawakami et al. | 340/784 |
| 4,405,868 | 9/1983 | Lockwood | 307/296 A |
| 4,635,128 | 1/1987 | Toyoda | 340/784 |
| 4,646,074 | 2/1987 | Hashimoto | 340/718 |
| 4,693,563 | 9/1987 | Harada et al. | 345/97 |
| 4,699,498 | 10/1987 | Naemura et al. | 350/330 |
| 4,748,444 | 5/1988 | Arai | 340/784 |
| 4,763,994 | 8/1988 | Kaneko et al. | 350/350 S |
| 4,772,881 | 9/1988 | Hannah | 340/703 |
| 4,802,739 | 2/1989 | Iwamoto | 350/332 |
| 4,824,218 | 4/1989 | Kuno et al. | 350/350 S |
| 4,870,398 | 9/1989 | Bos | 340/784 |
| 5,092,665 | 3/1992 | Kanbe et al. | 359/56 |
| 5,155,613 | 10/1992 | Sakayori | 359/85 |

FOREIGN PATENT DOCUMENTS

| | | | |
|---|---|---|---|
| 0121070 | 10/1984 | European Pat. Off. . | |
| 0167398 | 1/1986 | European Pat. Off. . | |
| 3501982 | 7/1985 | Germany . | |
| 52-24494 | 2/1977 | Japan | G09F 9/30 |
| 57-108892 | 7/1982 | Japan . | |
| 0160124 | 9/1984 | Japan . | |
| 61-149933 | 8/1986 | Japan | G02F 1/133 |
| 0294417 | 12/1986 | Japan . | |
| 0025730 | 2/1987 | Japan . | |
| 62-165630 | 7/1987 | Japan . | |
| 2075738 | 11/1981 | United Kingdom . | |
| 2139795 | 11/1984 | United Kingdom . | |
| 2157471 | 10/1985 | United Kingdom . | |
| 2162674 | 2/1986 | United Kingdom . | |
| 2164776 | 3/1986 | United Kingdom . | |

OTHER PUBLICATIONS

Morita, "Electrochromic Memory Degradation in $WO_x$–Li-$ClO_4$/PC Cells," Japanese Journal of Applied Physics, vol. 21, No. 4, pp. 655–658 (Apr., 1982).

*Primary Examiner*—Amare Mengistu

*Attorney, Agent, or Firm*—Fitzpatrick, Cella, Harper & Scinto

[57] ABSTRACT

A driving and switching off circuit is provided for a liquid crystal display device having a memory effect and a plurality of pixels, with each pixel capable of exhibiting two states in accordance with an electric field applied thereto. The circuit comprises a driving circuit for applying a drive signal to the display device to cause all of the pixels to uniformly exhibit one of the two states, a delay circuit for providing an end signal subsequent to the application of the drive signal and a switching circuit, responsive to the delay circuit, for switching off the display device subsequent to causing all the pixels to uniformly exhibit the one state.

4 Claims, 12 Drawing Sheets

Vcc
13
INFORMATION LINE DRIVER
11
16
BACK LIGHT
DISPLAY DATA
ERASE DATA
CONTROL SIGNAL
CONTROL SIGNAL
SCAN LINE DRIVER
12
SCAN LINE ADDRESS SIGNAL
Vcc
END SIGNAL
14
CONTROLLER
POWER OFF SIGNAL
26
DISPLAY CONTENT ERASE SIGNAL GENERATOR
Vcc
VIDEO RAM ADDRESS DATA
15
POWER CONTROLLER
Vcc
1
Vcc

BACK LIGHT
16
DISPLAY DATA
ERASE DATA
CONTROL SIGNAL
INFORMATION LINE DRIVER
13
11
CONTROL SIGNAL
ERASE SIGNAL
SCAN LINE ADDRESS SIGNAL
SCAN LINE DRIVER
12
END SIGNAL
CONTROLLER
14
VIDEO RAM ADDRESS DATA
DISPLAY CONTENT ERASE SIGNAL GENERATOR
26
2
Vcc

DISPLAY DEVICE WITH POWER-OFF DELAY CIRCUITRY

This application is a division of application Ser. No. 07/657,259, filed Feb. 19, 1991, which is a continuation of abandoned application Ser. No. 07/333,956, filed Apr. 6, 1989, which is a continuation of abandoned application Ser. No. 07/085,017, filed Aug. 13, 1987.

BACKGROUND OF THE INVENTION

1. Field of the Invention

The present invention relates to a display device for displaying data, and more particularly to a display device having a ferroelectric liquid crystal panel.

2. Related Background Art

The use of a bistable liquid crystal element has been proposed by Clark and Lagerwall (JP-A- 107216/1981 and U.S. Pat. No. 4,367,924). Ferroelectric liquid crystal having chiral smectic C phase (Sm C *) or H phase (Sm H *) is usually used as the bistable liquid crystal. This liquid crystal has bistable state to an electric field, including a first optically stable state (first orientation state) and a second optically stable state (second orientation state). Accordingly, unlike an optical modulation element used in a TN type liquid crystal, the liquid crystal is oriented in the first optically stable state for one electric field vector, and the liquid crystal is oriented in the second optically stable state for the other electric field vector. The liquid crystal of this type quickly responds to the applied electric field to assume one of the two stable states and maintains the state when the electric field is removed. Many of the problems involved in the TN type element are essentially resolved by making use of the above property.

In the display device which uses the TN type element, the TN type element has no memory function and hence the content of display is not stored in the display panel. Accordingly, no special means for erasing the display content is necessary from a security stand-point of confidential information. On the other hand, in the display panel which uses the bistable ferroelectric liquid crystal, the display content is stored in the display panel. In a transmission type display device which allows observation of the display content by illumination of a back light, the stored display content is not recognized when the back light is turned off, but when the back light is turned on, the stored display content appears. This raises a problem with security of confidential information.

In the liquid crystal display device of this type in which scan electrodes and information electrodes are arranged in a matrix and liquid crystal is filled between the electrodes to form a number of pixels to display the image, a scan signal is sequentially and periodically applied to the scan electrodes while a video signal is applied to the information electrodes in synchronism with the scan signal. In this case, the transfer of the video signal and the selection of the scan electrode are done by at least three signal lines for vertical synchronization signal VD, horizontal synchronization signal and video signal DATA. The vertical synchronization signal VD is produced at a period of one screen (one frame) time, and the horizontal synchronization signal is produced at a constant period (1H period) by at least the number required to scan the horizontal scan electrodes. The VD and HD are always in a fixed relation, that is, in a synchronized relation, and n video signals DATA are transferred in the 1H period, where n is the number of information electrodes.

In the transfer system which uses the three signal lines, a leading scan electrode of the screen is selected at the VD pulse, the scan starts from that scan electrode, and other the scan electrodes are sequentially scanned from the top to the bottom of the screen by the HD pulses. At the same time, the video signal DATA is transferred to the sequentially selected scan electrodes to form one screen. The above operation is repeated 30 times (30 frames) or more per second.

In a large size and multi-pixel display device, the frequencies of VD, HD and DATA are necessarily high if the display panel is driven at higher than 30 frames per second. For example, where the display panel has 400 scan electrodes and it is driven at 30 frames per second, the 1H period corresponds to 80 $\mu$ seconds.

When the ferroelectric liquid crystal is used as the material of the liquid crystal display panel, there is no known practical ferroelectric liquid crystal material which allows writing (updating) of pulses applied to the scan electrodes at a rate of 80 $\mu$ seconds per 1H period. If more than 80 $\mu$ seconds of time is given to the 1H period to apply the pulses so that the writing (updating) of the screen is done by the conventional signal transfer system and drive system, the number of frames is smaller than 30 frames per second. In this case, the scan state is visible by human beings and the quality of the displayed image deteriorates. Further, since the scan electrodes are sequentially scanned and all information electrodes have the video signal always applied in synchronism with the scan signal, the power consumption is high.

SUMMARY OF THE INVENTION

It is an object of the present invention to provide a display device with a display panel having a memory property, which can modify a display content for modified display data.

It is another object of the present invention to provide a display device with a display panel having a memory property, which can erase displayed data.

It is another object of the present invention to provide a display device which divides scan lines of a display panel into blocks to allow rewriting of display for each block.

It is another object of the present invention to provide a display device which sends modified display data to a display panel to modify a display content.

It is another object of the present invention to provide a display device which displays data while maintaining synchronization between a display panel and an image data transmitter.

DETAILED DESCRIPTION OF THE PREFERRED EMBODIMENTS

[First Embodiment]

Chiral smectic liquid crystal having ferroelectric property is particularly suitable as a liquid crystal material used in the present invention. Specifically, chiral smectic C phase (Sm C *), kairalsmechtic G phase (Sm G *), kairalsmechtic F phase (Sm F *), kairalsmechtic I phase (Sm I *) or chiral smectic H phase (Sm H *) liquid crystal may be used. Details of the ferroelectric liquid crystal are described in "Ferroelectric Liquid Crystals" LE JOURNAL DE PHYSIQUE LETTERS 1975, NO. 36(L-69), "Submicro Second Bistable Electro-optic Switching in Liquid Crystals" Applied Physics Letters, 1980, No. 36 (11), and "Liquid Crystals" Solid-State Physics of Japan, 1981, NO. 16(141). The present invention may use the ferroelectric liquid crystals disclosed in those articles.

Specific examples of the ferroelectric liquid crystal compound are decyloxybenzylidene-p'-amino-2-methylbutylcinnamate (DOBAMBC), hexyloxybenzylidene-p'-amino-2-chloropropylcinnamate (HOBACPC), and 4-o-(2-methyl)-butylresorcylidene-4'-octylaniline (MBRA 8). The ferroelectric liquid crystal which exhibits cholesteric phase at a temperature higher than that of a chiral smectic phase liquid crystal is most preferable. For example, biphenylester liquid crystal which exhibits a phase transition temperature described in the embodiment may be used.

When the element is constructed by using one of those materials, the element may be supported by a copper block having a heater embedded therein in order to keep the element at a temperature at which the liquid crystal compound exhibits a desired phase.

Figure 3:
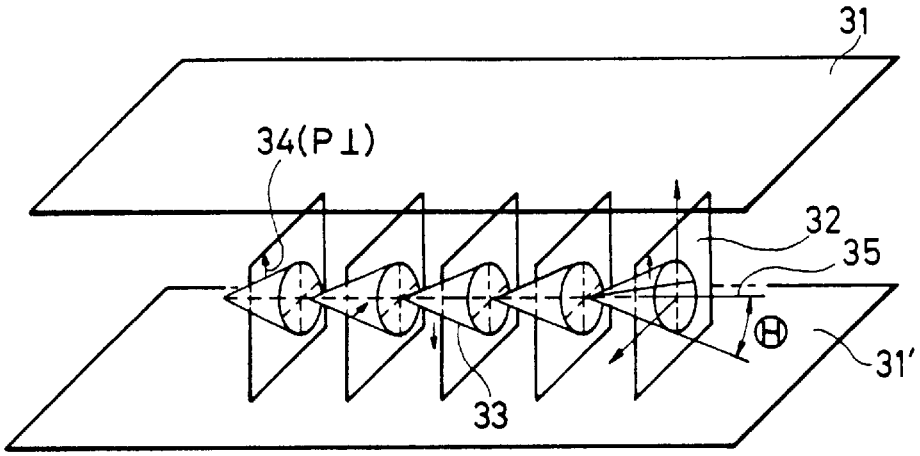
FIGS. 3 and 4 show perspective views of ferroelectric liquid crystal elements used in the present invention.

FIG. 3 shows a cell to explain the operation of the ferroelectric liquid crystal. The Sm C * phase is assumed as the desired phase.

Numerals 31 and 31' denote substrates (glass plates) covered by transparent electrodes made of thin films such as $In_2O_3$, $SnO_2$ or ITO (indium-tin oxide), and Sm C * phase liquid crystal which is oriented such that a liquid crystal molecule layer 32 normal to the glass plate is filled therebetween. Thick lines 33 represent the liquid crystal molecules which form a continuous spiral structure in parallel with the substrate plane. An angle between a center axis 35 of the spiral structure and an axis of the liquid crystal molecules 33 is represented by Ⓗ. The liquid crystal molecules 33 each has a bipolar moment (P⊥) 34 orthogonally to the molecule. When a voltage higher than a predetermined threshold is applied between the substrates 31 and 31', the spiral structure of the liquid crystal molecules 33 is released and the liquid crystal molecules 33 may be reoriented so that all the bipolar moments (P⊥) 34 are oriented along the electric field. The liquid crystal molecule 33 has an elongated shape, with a refractive index along a major axis and being different from the refractive index along a minor axis. Thus, when polarizers which are cross-nicol to each other are placed on the opposite sides of the glass plate, a liquid crystal optical element whose optical characteristic changes depending on a polarity of applied voltage is provided.

Figure 4:
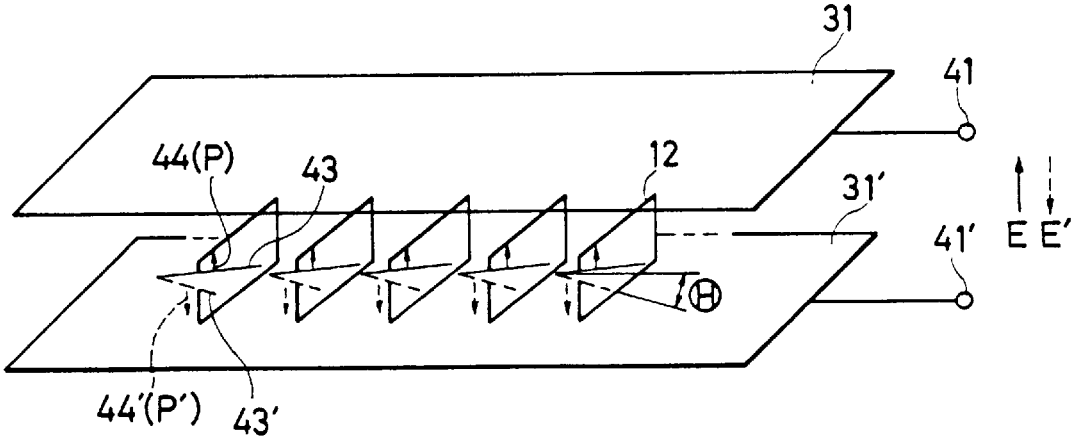

The liquid crystal cell preferably used in the liquid crystal optical element of the present invention may be very thin (for example, 10 μm or less). As the liquid crystal layer becomes thinner, the spiral structure of the liquid crystal molecules is released even under non-application of the electric field as shown in FIG. 4, and the bipolar moment P or P' is oriented either upward (44) or downward (44'). One half of an angle between the molecule axis of the liquid crystal molecule 43 and a direction 43 is called a tilt angle (Ⓗ) which is equal to one half of an apex angle of a cone of the spiral structure. Electric field E, or E' of opposite polarity, which is higher than a predetermined threshold, is applied to such a cell by voltage application means 41 or 41' as shown in FIG. 4. Thus, the bipolar moment is reoriented upward 44 or downward 44' in accordance with the electric field vector of the electric field E or E', and the liquid crystal molecules are oriented in either the first stable state 43 or the second stable state 43'.

There are two advantages in utilizing the ferroelectricity as the liquid crystal optical element, as described above. First, the response speed is very fast, and secondly, the orientation of the liquid crystal molecule is bistable. The second advantage is explained with reference to FIG. 4. When the electric field E is applied, the liquid crystal molecule is oriented in the first stable state 43 which is stable even after the electric field is removed. When the electric field E' of the opposite polarity is applied, the liquid crystal molecule is oriented in the second stable state 43' which is also stable even after the electric field is removed.

The cell is preferably as thin as possible in order to effectively attain the fast response speed and the bistability.

Figure 1:
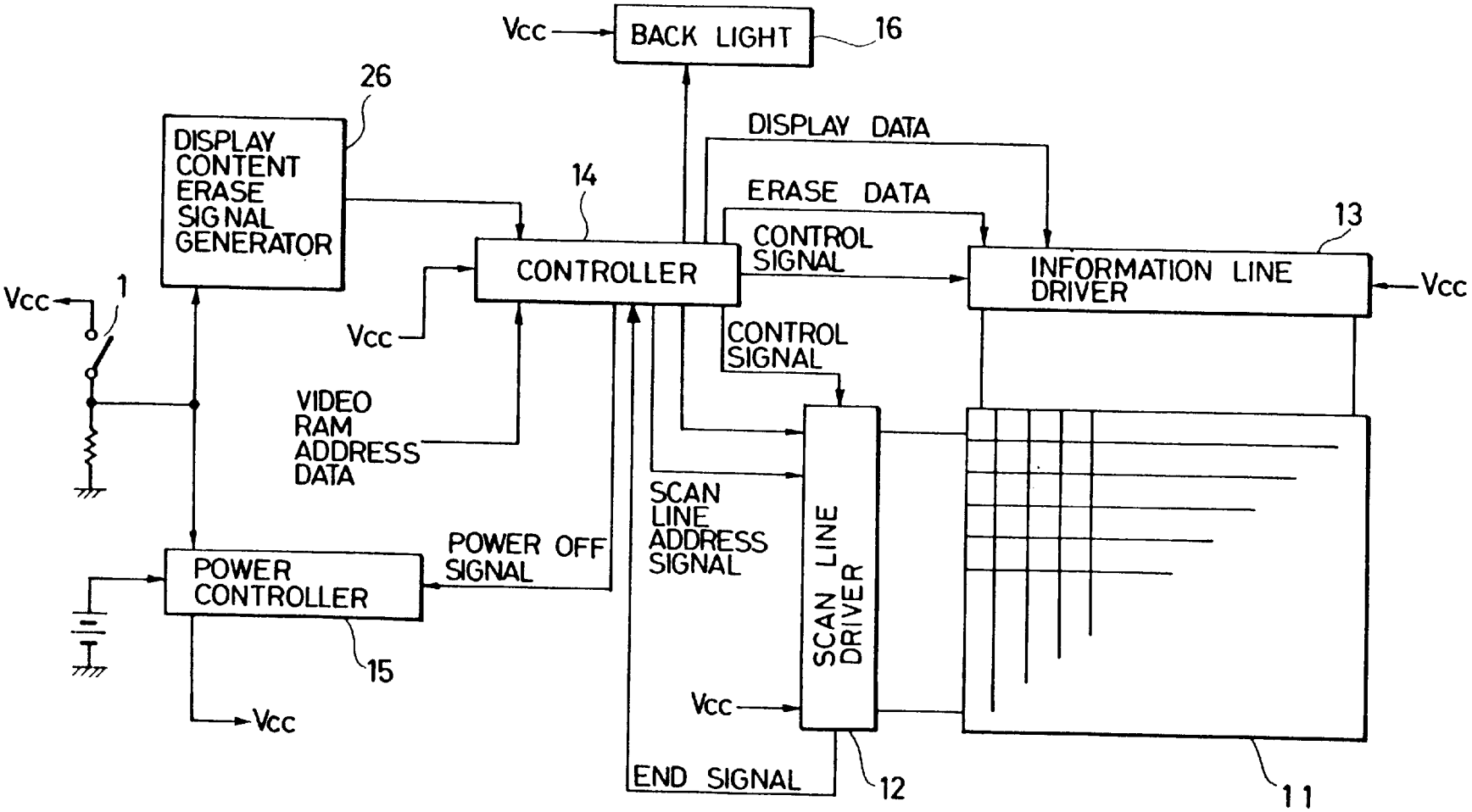
FIGS. 1 and 2 show circuit configurations of the present invention.

FIG. 1 shows a circuit configuration of a display device of the present invention. Numeral 11 denotes a ferroelectric liquid crystal display panel, numeral 12 denotes a scan line driver, numeral 13 denotes an information line driver, numeral 14 denotes a controller, and numeral 16 denotes a back light arranged on a back side of the display panel 11.

In the display device shown in FIG. 1, when an operator turns off a main switch 1 to terminate the display, a signal is generated by a display content erase signal generator 26 and it is supplied to the controller 14. The scan line driver 12 and the information line driver 13 are controlled by a control signal from the controller 14, and an erase signal is supplied to the scan line driver 12 and erase data is supplied to the information line driver 13, from the controller 14.

Figure 5:
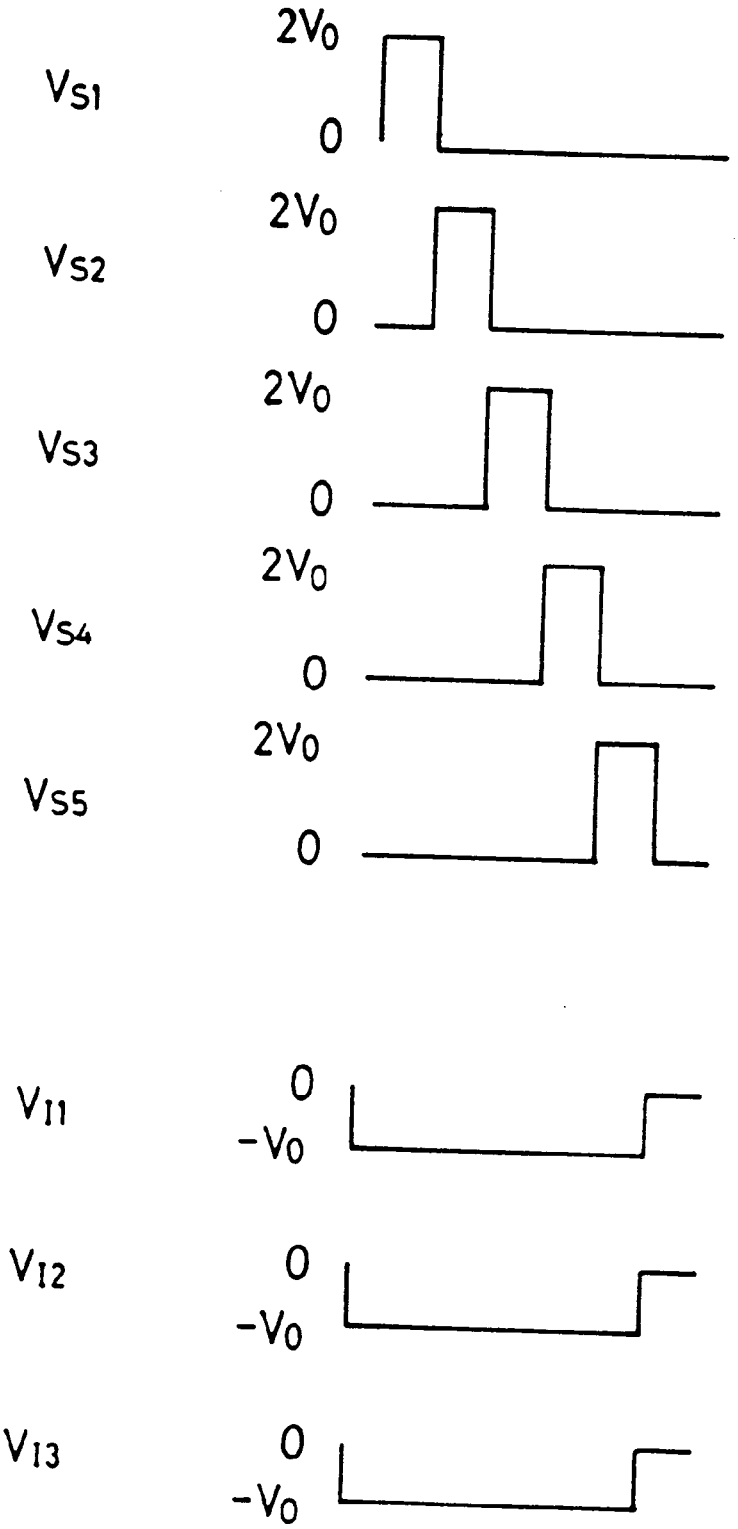
FIG. 5 shows a waveform of a display content erase voltage used in the present invention.

The signal supplied from the scan line driver 12 when the display content is to be erased may be identical to the scan signal used for writing. A signal to orient the ferroelectric liquid crystal to one stable state (white) is simultaneously applied to the information lines in synchronism with the output signal of the scan line driver 12. FIG. 5 shows the signals $VS_1$, $VS_2$, . . . produced by the scan line driver 12 and the signals $VI_1$, $VI_2$, . . . produced by the information line driver 13. In the present invention, instead of those signals, a $2V_0$ pulse may be simultaneously applied to the scan lines, and a $-V_0$ pulse may be applied to the information lines in synchronism therewith.

After the display content has been erased, the scan line driver 12 supplies an end signal to the controller 14 which sends a power-off signal to a power controller 15 so that the power is tuned off.

In the present invention, when the display content is to be observed by the illumination of the back light 16 arranged behind the display panel 11, the display content erase signal is supplied to the controller 14 which controls the turn-off of the back light 16.

When data is to be displayed on the display device, video RAM address data is sent to the controller 14 which produces the control signal supplied to the scan line driver 12 and the information line driver 13. The controller 14 decodes the video RAM address data and sends a scan line address signal and a display data to the scan line driver 12 and the information line driver 13, respectively.

Figure 2:
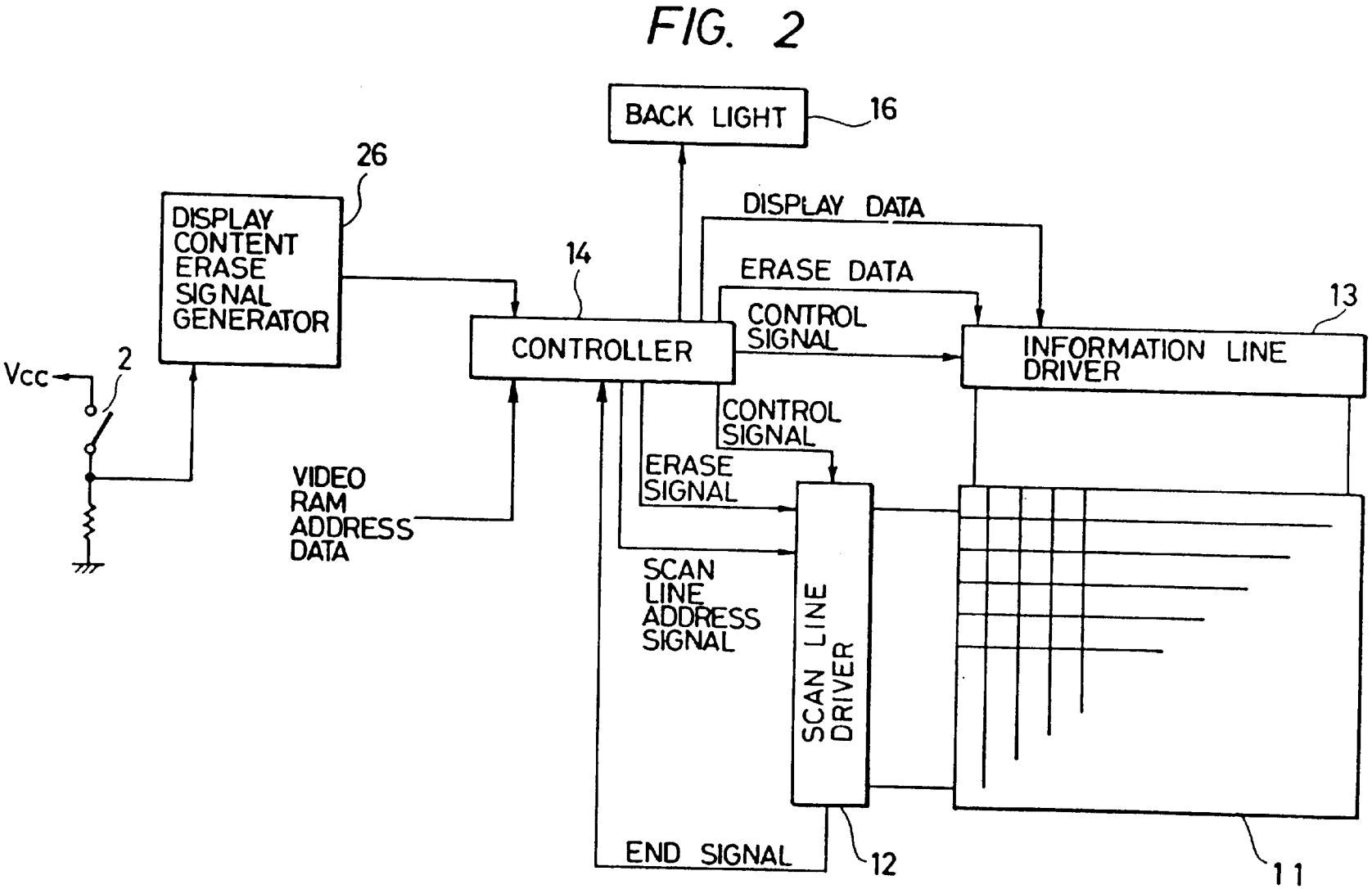

FIG. 2 shows a circuit configuration of another embodiment of the display device of the present invention.

In the display device of FIG. 2, when an operator turns on a main switch 2 to start the display, a signal is generated by the display content erase signal generator 26 and it is supplied to the controller 14. The scan line driver 12 and the information line driver 13 are controlled by a control signal from the controller 14, and erase data is supplied to the scan line driver 12 and blank data is supplied to the information line driver 13, from the controller 14. The drive signals produced by the scan line driver 12 and the information line driver 13 may be the drive signals shown in FIG. 5.

After the display content has been erased, an end signal is supplied from the scan line driver 12 to the controller 14 and the scan line driver 12 and the information line driver 13 are controlled to drive the display.

In the display device shown in FIG. 2, when the display content is to be observed by the illumination of the back light 16 arranged behind the display panel 11, the turn-on of the back light 16 is controlled by the controller 14 which receives the end signal.

In the present invention, the voltages to erase the display content stored in the display panel 11 are the scan signals $VS_1$, $VS_2$, . . . on the scan lines and the erase signals $VI_1$, $VI_2$, . . . on the information lines, as shown in FIG. 5, A.C. voltages are preferable.

Figure 6A:
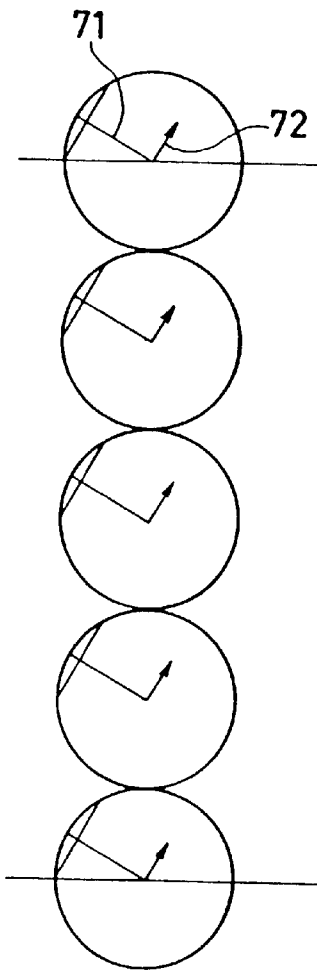
FIGS. 6A and 6B show projections of a director of a chiral smectic layer in a uniform orientation.
Figure 6B:
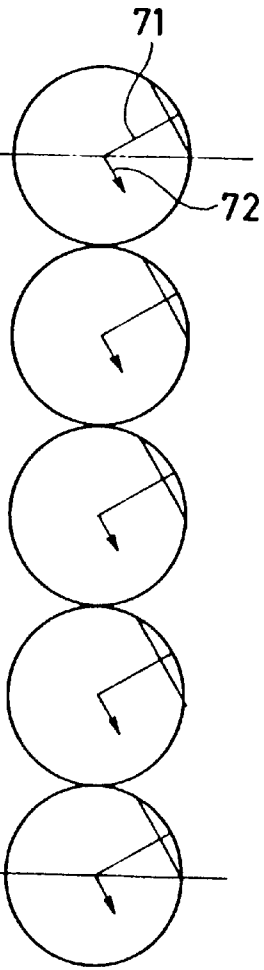

In the present invention, the above A.C. voltages are utilized to form the uniform orientation of the ferroelectric liquid crystal element shown in FIGS. 6A and 6B.

Figure 7A:
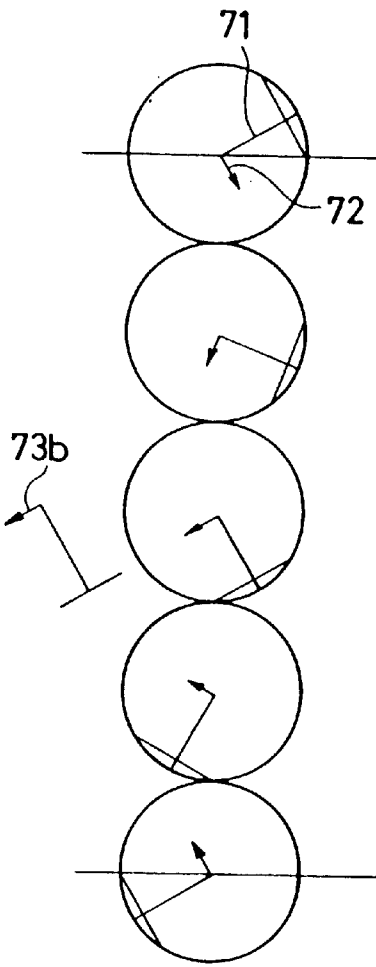
FIGS. 7A and 7B show projections of a director of a chiral smectic layer in a twist orientation.
Figure 7B:
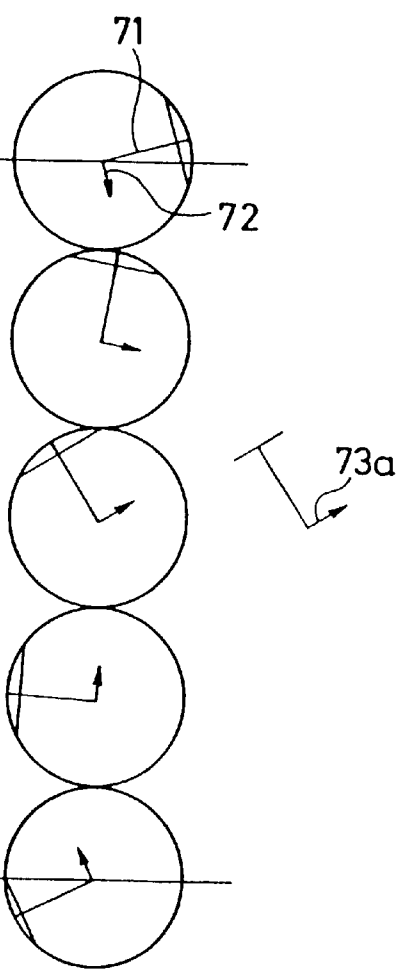

The above ferroelectric liquid crystal element is more easily attained in the twist orientation in which the liquid crystal molecules are twisted from the upper substrate to the lower substrate in the molecular layer as shown in FIGS. 7A and 7B than in the uniform orientation in which the liquid crystal molecules are arranged in parallel in the liquid crystal molecule layer as shown in FIGS. 6A and 6B. When the liquid crystal molecules are in the twist orientation, the apparent tilt angle between the liquid crystal molecule axes in the first orientation and second orientation is small, resulting in the reduction of contrast and transmitted light as well as overshoot in the response of the liquid crystal molecule when the orientation is switched. This causes fluctuation of the transmitted light due to flicker of the display image. Accordingly, the display device having the liquid crystal molecules uniformly oriented is preferable.

FIGS. 7A and 7B shows a director or C director 71 cut in a plane of a smechtic layer of a bistable liquid crystal cell when the spiral structure is released, and an array of self-polarizations 72. A top circle (which corresponds to a projection of the liquid crystal cone onto the smechtic layer) shows a state near the upper substrate, and a bottom circle shows a state near the lower substrate. In FIG. 7A, an average self-polarization 73*b* is oriented downward, and in FIG. 7B, an average self-polarization 73*a* is oriented upward. Accordingly, switching takes place between the state of FIG. 7A and the state of FIG. 7B depending on the electric field.

FIGS. 6A and 6B show arrays of C directors when there is no twist along the direction of thickness of the liquid crystal cell, that is, in an ideal state. For general purposes, the liquid crystal molecules are shown as somewhat tilted to the substrate plane. The direction of the self-polarization is upward in FIG. 6A and downward in FIG. 6B. The uniform orientation shown in FIGS. 6A and 6B is attained by applying to the ferroelectric liquid crystal in the twist orientation shown in FIGS. 7A and 7B an A.C. voltage higher than a threshold voltage (10–500 V) at a frequency of higher than 0.1 Hz, preferably 10 Hz–5 KHz.

In the present embodiment, the uniform orientation of the ferroelectric liquid crystal element may also be attained by the A.C. voltage applied to the display panel when the display content is to be erased. In this case, the display content erase voltage may be an A.C. voltage of 10 V–500 V at a frequency of higher than 0.1 Hz.

In the display device of the present invention, the above display content erase voltage may be applied at either start time or end time of the operation.

In accordance with the present invention, the display content previously written is erased at the start time of operation of the display device, and the uniform orientation of the ferroelectric liquid crystal element is attained.

[Second Embodiment]

Figure 8:
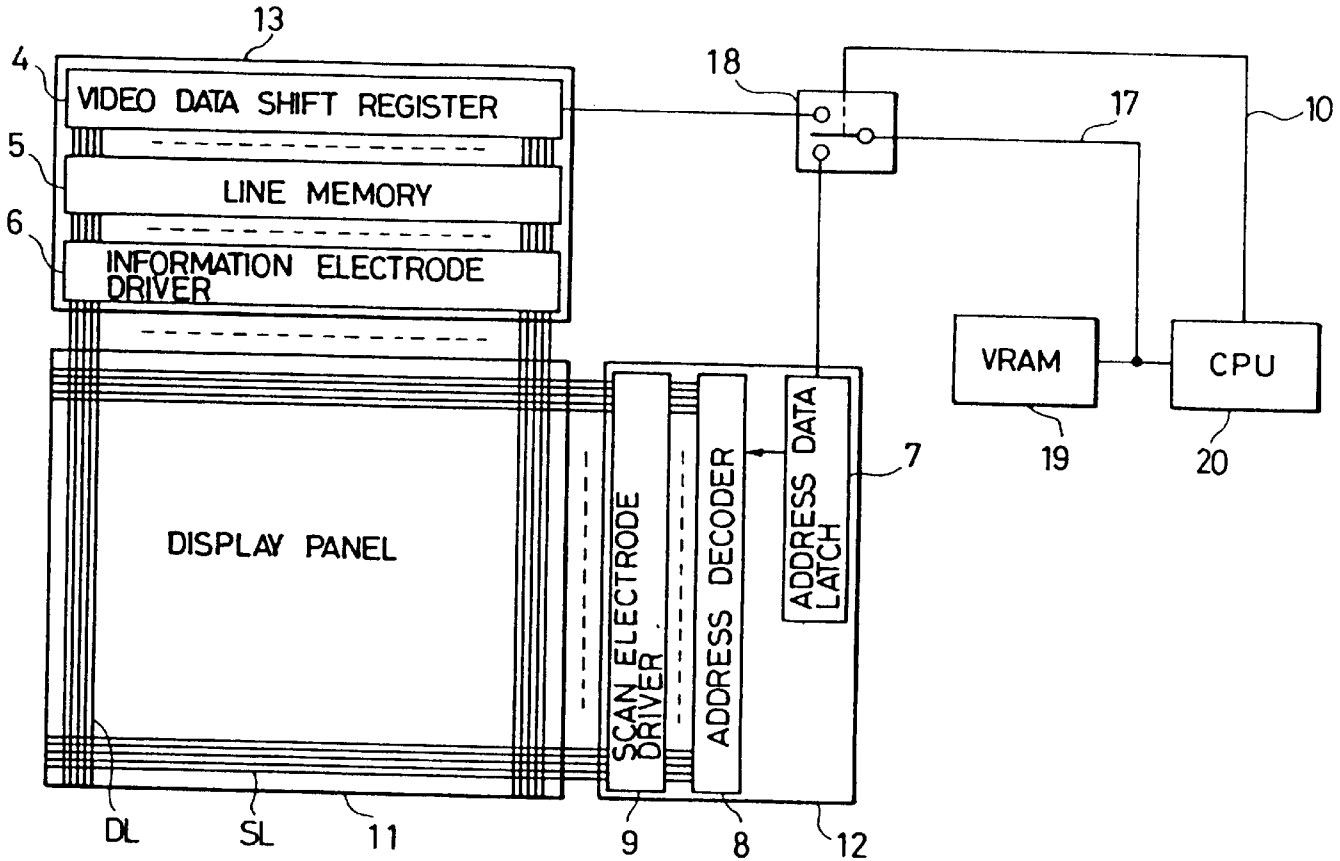
FIG. 8 shows one embodiment of a display panel of the present invention.

FIG. 8 shows a block diagram of a second embodiment of the display device of the present invention. Numeral 11 denotes a display panel, and ferroelectric liquid crystal is filled between information line electrodes DL (640 lines) and scan line electrodes SL (400 lines). Numeral 13 denotes an information line driver which supplies a signal to the information line electrodes DL. Numeral 12 denotes a scan line driver which supplies a signal to the scan line electrodes SL. Numeral 4 denotes a video data shift register which receives one line of serial video data sent for displaying on the display panel 11. Numeral 5 denotes a line memory which parallelly receives one line of serial data sent to the video data shift register 13 and stores it. Numeral 6 denotes an information electrode driver which applies voltages to the information line electrodes DL in accordance with one line of data stored in the line memory 5.

Numeral 7 denotes an address data latch which latches an address data to designate one of the scan line electrodes SL sent with the video data sent for displaying on the display panel 11. Numeral 8 denotes an address decoder which selects one of the scan line electrodes SL to which the voltage is to be applied in accordance with the address data latched in the address data latch 7. Numeral 9 denotes a scan electrode driver which applies a voltage to the scan line electrode SL selected by the address decoder 8. Numeral 10 denotes a designation signal line which designates address field and data field of the data sent for displaying. Numeral 17 denotes an address data line through which an information signal from the image memory VRAM is transferred. Numeral 18 denotes a switch which switches the information signal from the address data line 11 to the video data shift register 4 or the address data latch 7 in accordance with a signal from the switch signal line 10. Numeral 19 denotes an image memory which stores the image data consisting of pixels at the crosspoints of the information line electrodes DL and the scan line electrodes SL of the display panel 11, for each of the bits corresponding to the pixels. Numeral 20 denotes a CPU which controls rewriting of the image memory 19, sends the scan line address corresponding to the rewritten row and the information signal which is the image data of that row to the address data line 17, and sends the designation signal to the designation signal line 10.

Figure 9:
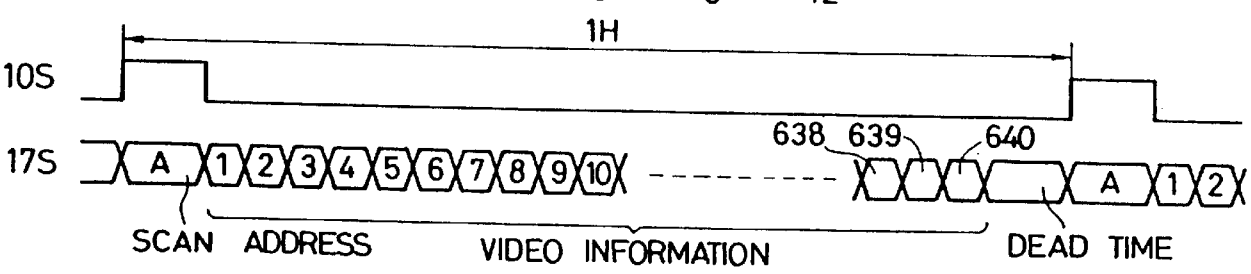
FIG. 9 shows a signal transfer system in the embodiment of the present invention.

FIG. 9 shows a timing chart of a designation signal 10S on the designation signal line 10 and an information signal line 17S on the address data line 17. The information signal lines illustrates, in abbreviated fashion, lines 1 through 640 of the information line electrodes DL.

When the designation signal 10S is high level, the information signal 17S includes a scan line electrode address which designates one of the scan line electrodes SL, and if the subsequent designation signal 10S is low level, the information signal 17S serially transfers the video signal, that is, data on the voltages for each of the information line electrodes DL. Before the designation signal 10S becomes high level, there is a period of dead time which is used for an external transfer unit and a very short period.

When the designation signal 10S is high level, the switch 18 switches the address data line 17 to the address data latch 7. As a result, the scan electrode address in the information signal 17S is latched in the address data latch 7 and the voltage is applied to one of the scan line electrodes SL by the scan electrode driver 9 through the address decoder 8.

When the designation signal 10S is low level, the switch 18 switches the address data line 17 to the video data shift register 4. As a result, the video information in the information signal 17S is sent to the video data shift register 4, and the voltage is applied or not applied to the information line electrodes DL by the information electrode driver 6 through the line memory 5.

The scan line electrode address to be sent to the scan electrode driver 12 and the video information to be sent to the information electrode driver 13 are sent through one address data line 17 with the selected scan line electrode address first followed by the video image of the selected scan line electrode. In this manner, the serial transfer of the signals is attained.

In the liquid crystal display panel which uses the ferroelectric liquid crystal having the memory property, only the scan electrodes for the pixels to be written (rewritten) are scanned in the partial writing (rewriting) of the screen without changing the other portion of the screen.

In accordance with the signal transfer system of the present invention, the selected scan electrode address is attached to the head of the information signal DATA, and the video information of the selected scan electrode is sent following thereto. The information signal DATA is transferred in synchronism with the address/data signal which functions to distinguish the scan electrode address from the video information, and partial writing (rewriting) of any scan electrode is attained. By the partial writing (rewriting), an apparent response speed of the display of the large size and multi-pixel liquid crystal display panel which uses the ferroelectric liquid crystal, and which cannot normally respond fast, is improved. By the partial writing (updating), the number of scan electrodes to which the voltages are applied is reduced and the voltages are applied individually. Thus, the power consumption is reduced.

When the signal transfer system of the present invention is used to attain the partial writing (rewriting), the above advantages are offered.

[Third Embodiment]

Figure 10:
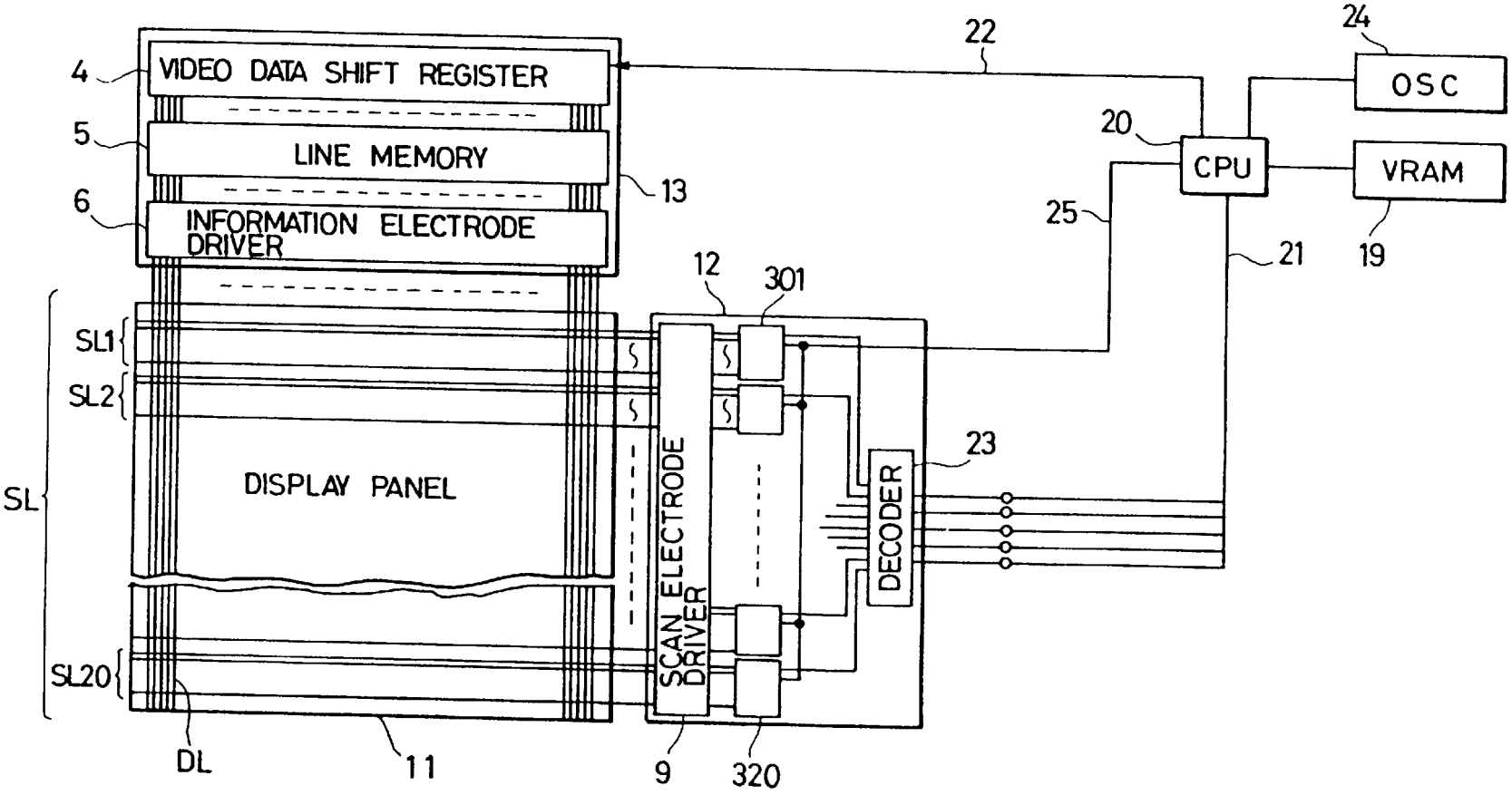
FIG. 10 shows another embodiment of a display panel of the present invention.

FIG. 10 shows a configuration of a third embodiment of the present invention.

Numeral 11 denotes a display panel which comprises scan electrodes 2 including 20 scan electrode blocks 201, 202, . . . 220, 640 information electrodes 3 and ferroelectric liquid crystal filled between the scan electrodes 2 and the information electrodes 3. Orientation of the ferroelectric liquid crystal is changed by an electric field created by voltages applied to the electrodes at crosspoints of the matrix of the scan electrodes 2 and the information electrodes 3.

Numeral 13 denotes an information electrode driver which comprises a video data shift register 4 for storing 640 serial video data from the information signal line 6, a line memory 5 for storing parallel video data from the video data shift register 4, and an information electrode driver 6 for applying a voltage to the information electrodes DL in accordance with the vidoe data stored in the line memory 5.

Numeral 12 denotes a scan electrode driver which comprises a decoder 23 for selecting one of the 20 blocks in accordance with the address data from a block address data line 21, 20-bit shift registers 301–320 for storing signals from the decoder 22, and a scan electrode driver 9 for applying voltages to the scan electrodes SL block by block in accordance with the signals from the shift registers 301–320.

Numeral 22 denotes an information signal line for transferring the video data to the video data shift register 4, numeral 25 denotes a clock pulse line for transferring a clock signal used as a shift clock for the shift registers 301–320, numeral 21 denotes a block address line for transferring 5-bit block address data to the decoder 23, numeral 20 denotes a CPU which receives a clock pulse from an oscillator 24 and controls the image memory 19 and the signal transfer to the information signal line 22, clock pulse line 25 and block address 21.

Numeral 24 denotes the oscillator which generates the clock pulse to clock the entire display device and supplies it to the CPU 20. Numeral 19 denotes the image memory which stores the image data consisting of pixels at the crosspoints of the scan electrodes SL and information electrodes DL of the display panel 11.

The operation of the display device will be explained.

In the scan electrode driver 12, address data A0–A4 for selecting the scan electrodes SL1–SL20 is applied to the decoder 23 which selects one of the 20 scan electrode blocks SL1–SL20 in accordance with the address data. The CPU 20 selects a block corresponding to the block of the image memory 19 which has been rewritten. The circuit for each block includes 20-bit shift register 301–320, and the selected block sequentially scans the 20 lines starting from the top scan line in the block by the pulse supplied from the shift pulse line 25. The scan signal is supplied to the scan electrode driver 9 through which the drive pulse is supplied to the scan electrodes SL of the display panel 11. The pulse from the shift pulse line 27 is always active whether the scan is started or stopped. Accordingly, the start and end of the scan is determined by the timing selected by the decoder 23.

On the other hand, the video information which controls the light transmission of the pixels of the display panel 11 is supplied from the information signal line 22 to the video data shift register 4 which shifts it left for each one pixel information so that the video information of the pixels corresponding to the 640 information electrodes DL is separated. After one scan line of horizontal shift is completed in the video data shift register 4, the video information is transferred to the line memory 5 and temporarily stored therein.

The information electrode driver 13 repeats the above operation for one block (20 times) in synchronism with the scan electrode driver so that the drive pulses are produced by the information electrode driver.

In this manner, one block is partially written. When the partial writing is to be done over a plurality of blocks, the one block partial writing is repeated a plurality of times.

In accordance with the present invention, in the liquid crystal display device which uses the ferroelectric liquid crystal having the memory property, only the scan electrodes of the scan electrode block to which the scan electrodes of the pixels to be written belong are scanned in the partial writing of the screen so that the partial writing is attained without changing the other portion of the screen.

By the partial writing, the apparent response speed of the display of the display panel which uses the ferroelectric liquid crystal which cannot satisfy the required response speed is increased, and the writing is attained without being visually recognized by the human eye.

By the partial writing, the number of scan electrodes to which the voltages are applied is minimum and the voltages are individually applied to the electrodes. Therefore, the power consumptions is saved.

[Fourth Embodiment]

Figure 11:
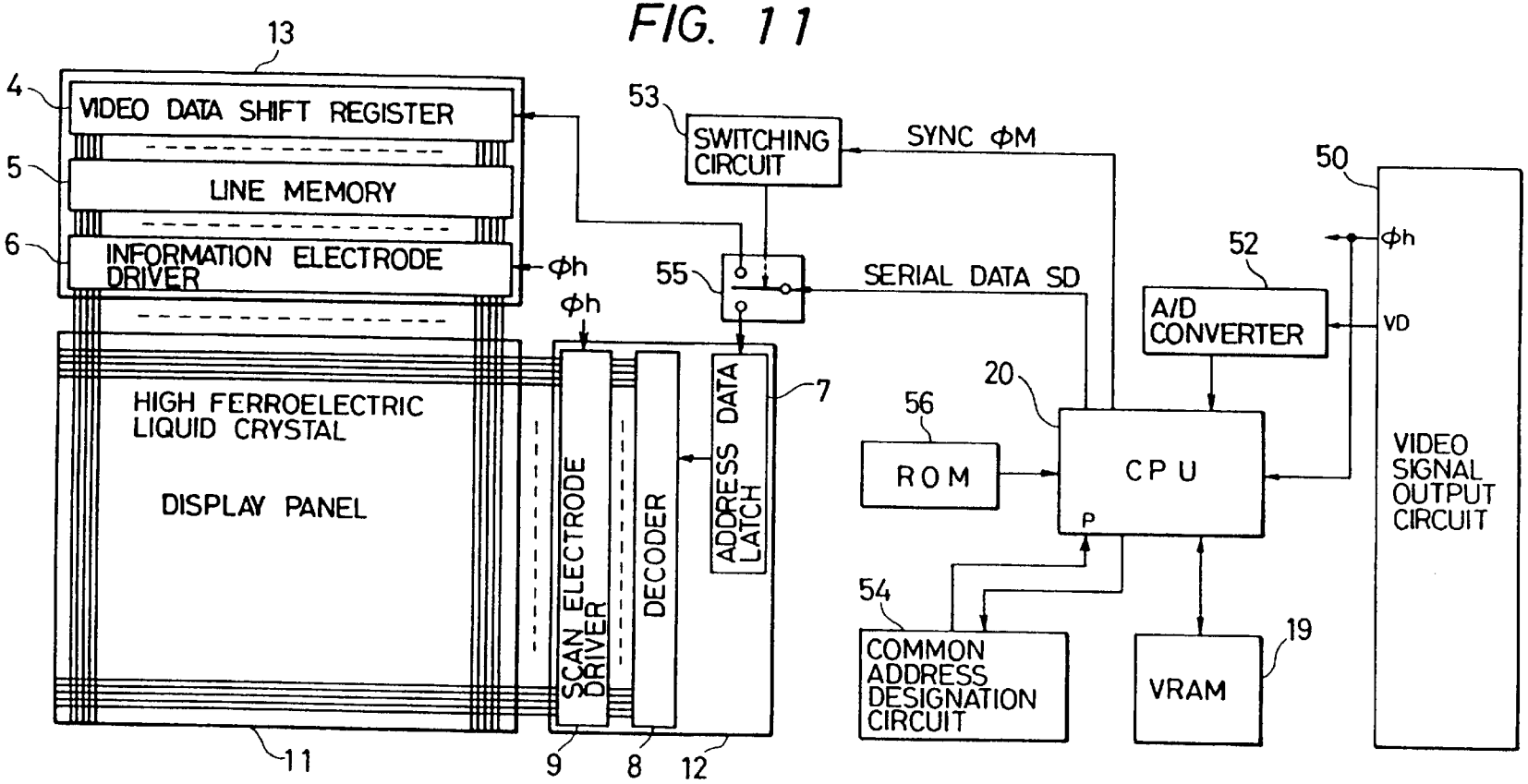
FIG. 11 shows a block diagram to explain the drive of a ferroelectric liquid crystal display panel in the embodiment of the present invention.

In FIG. 11, a video signal output circuit 50 may be a television signal receiver which produces a horizontal synchronization signal on and an analog video signal VD. The analog video signal VD is applied to an A/D converter 52 which produces a digitized video data, which is supplied to a CPU 20. The CPU 20 supplies the video data of each frame to a two-frame VRAM (video RAM) 19 which temporarily stores it. The CPU 20 also supplies a synchronization signal ϕM generated by a horizontal synchronization signal ϕh supplied from the video signal output circuit, to a switching circuit 53 of the ferroelectric liquid crystal display device. A designation circuit 54 is a coincidence circuit which compares the one frame of video data temporarily stored in the VRAM 19 with a frame of video data next applied to the CPU 20, sequentially by line and supplies a mismatch signal P to the CPU 20. The switching circuit 53 separates the serial data SD supplied from the CPU 20 into the video data and common address data by a switch 55 and supplies them to the information electrode driver 13 and the scan electrode driver 12 of the ferroelectric liquid crystal display panel (having 400 scan electrodes) 11. The information electrode driver 13 comprises a signal shift register 4, a line memory 5, and an electrode driver 6, and it sequentially shifts the input video data by one line (1H) at a time. The scan electrode driver 12 comprises an address data latch 33, a decoder 34 and a scan electrode driver 35 and it decodes the common ddress data latched in the address data latch 7 by the decoder 8 so that the scan electrode driver 9 drives the scan electrode of the selected address.

Figure 12:
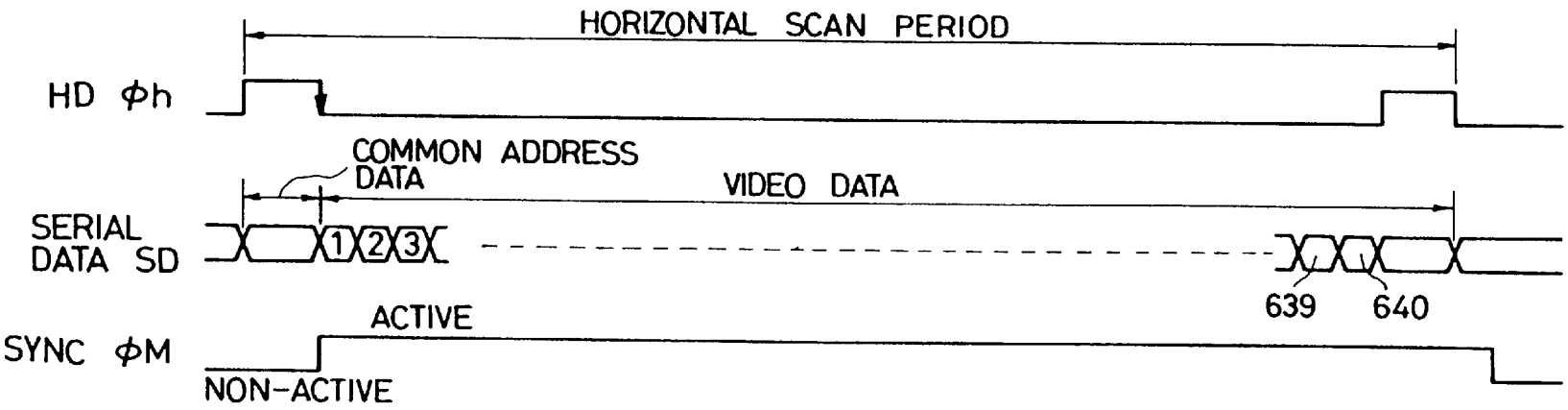
FIG. 12 shows a timing chart of the embodiment of the present invention.
Figure 13:
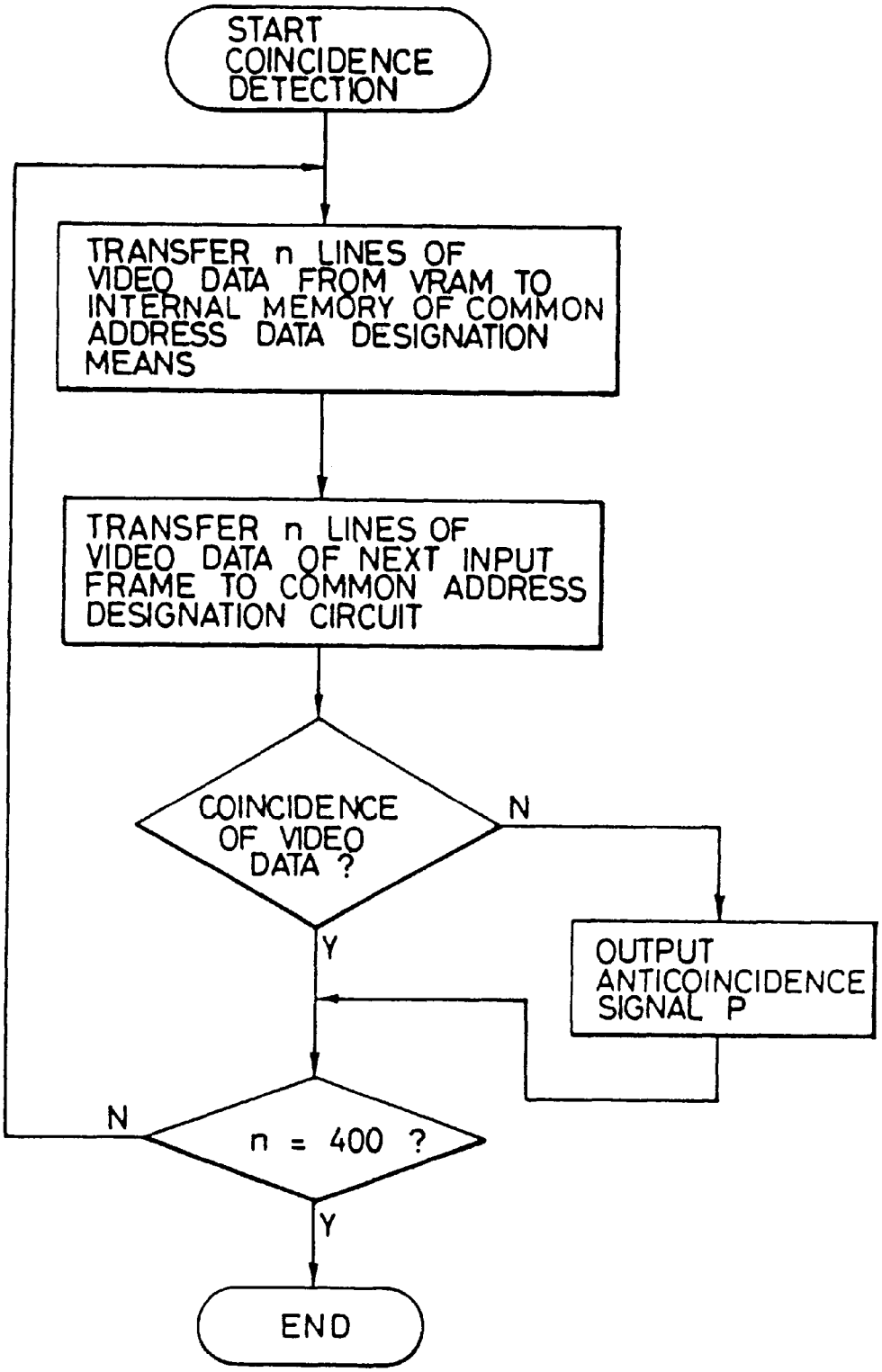
FIG. 13 shows a flow chart of an operation of a common address data designation circuit.

The operation of the present embodiment is explained with reference to a timing chart of FIG. 12 and a flow chart of FIG. 13.

The video signal supplied from the video signal output circuit (for example, television signal receiver) 50 is applied to the A/D converter 52 which produces the digitized video data, which is supplied to the CPU 20. The CPU 20 temporarily stores the video data for each frame alternately into the two-frame VRAM 19. The common address designation circuit 54 compares the video data of the temporarily stored previous frame and the video data of the next input frame, line by line, in accordance with the flow chart of FIG. 13 to detect the common address of the scan electrode whose data has been changed and produces a mismatch signal P. The CPU counts the mismatch signal P, fetches the address data of that count from the ROM 56 and produces a serial data SD having the video data of the address in the video data of the next frame stored in the VRAM 19, serially added thereto. The serial data SD is produced as shown in the timing chart of FIG. 12 with the common address data produced at the rise time of the horizontal synchronization signal ϕh being added to the front of the video signal. The switching circuit 53 actuates the switch 55 in synchronism with the rise of the synchronization signal ϕM supplied by the CPU 20, and supplies the video data to the information electrode driver 13 and the common address data to the scan electrode driver 12. In this manner, the synchronization of the video data and the common address data is secured. The address data of the scan electrode whose data has been changed is supplied to the address data latch 7 and decoded by the decoder 8 so that the scan electrode of the selected address is scanned by the scan electrode driver 9 and only the image of the common address data is changed. For example, if the video data of the previous frame and the video data of the next frame are different in the common address data n ($0 \leqq n \leqq 400$), the CPU 20 outputs only the video data of the next frame corresponding to the common address data n to change the image of the n-th scan electrode of the ferroelectric liquid crystal display panel 11.

The ferroelectric liquid crystal panel 11 can maintain the video data by its memory property even after the signal line of the driver has been blocked, and can change only a portion of the image by applying the drive signals to portions of scan electrodes and signal electrodes. Accordingly, the above operation creates no problem in the display.

In the present embodiment, the serial data SD is produced in order to synchronize the video data with the common address data. Alternatively, the video data and the common address data may be separately and directly applied to the signal electrode driver and the scan electrode driver, respectively, so long as they are synchronized. In the present embodiment, the ferroelectric liquid crystal panel is used although the present invention is applicable to other liquid crystal panel having the memory property.

In accordance with the present invention, when only a portion of the screen of the liquid crystal display panel having the memory property is to be changed, it is changed by scanning only that portion of the screen and not scanning the entire screen. Accordingly, the apparent display response speed is increased and the power consumption is significantly reduced.

[Fifth Embodiment]

Figure 14:
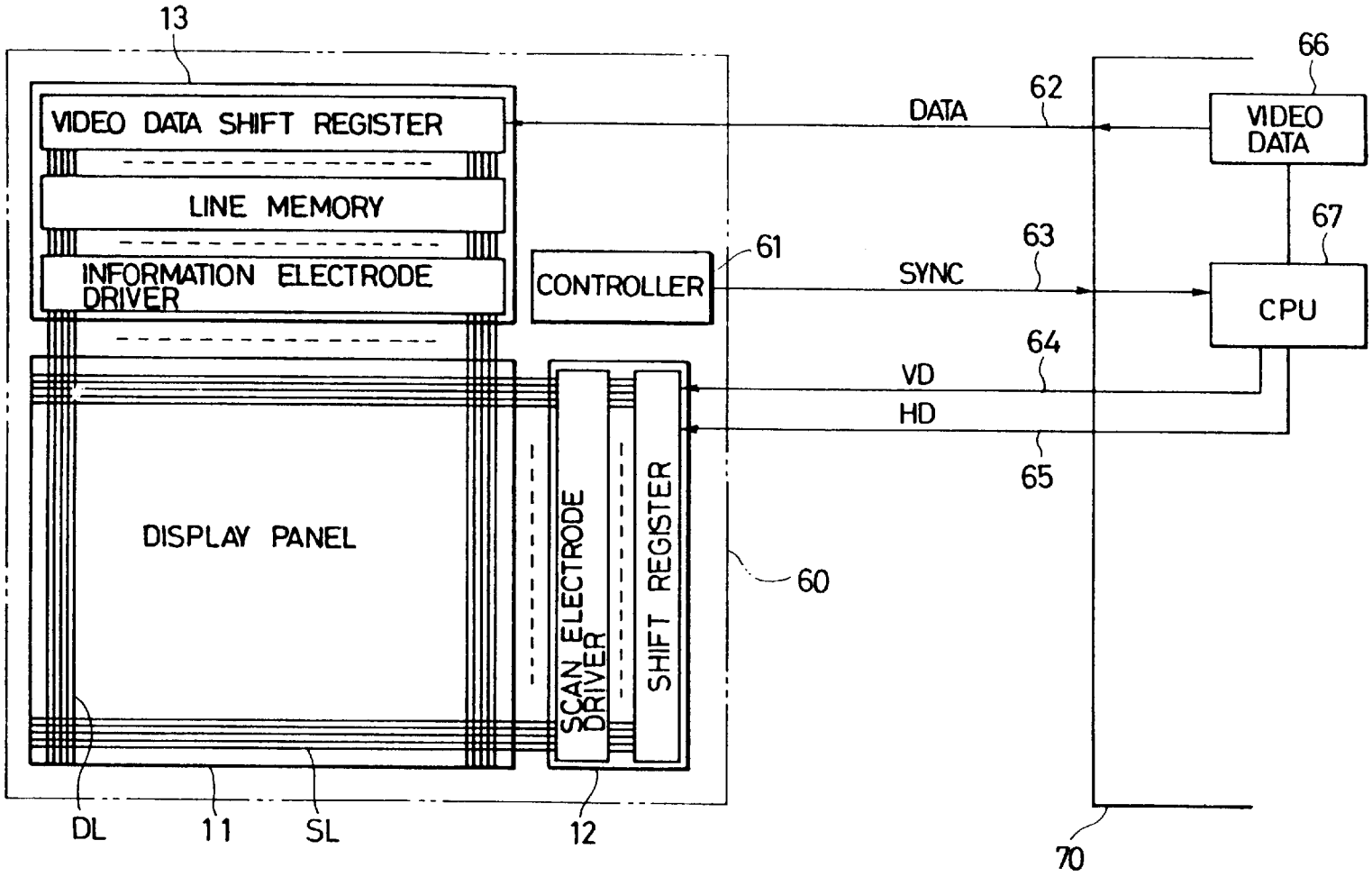
FIG. 14 shows transmitter and receiver in the embodiment of the present invention.

FIG. 14 shows a block diagram of a fifth embodiment of the display device of the present invention.

Numeral 60 denotes a display and numeral 70 denotes a transmitter which sends data to be displayed to the display 60 and controls the display 60. The display 60 includes a display panel 11 which has scan electrodes SL and information electrodes DL, and also has an information electrode driver 13 including a video data shift register, a line memory and an information electrode driver for applying signals to the information electrodes DL, a scan electrode driver 12 including a shift register and a scan electrode driver for applying signals to the scan electrodes SL, and a control circuit 61 for producing a synchronization signal.

Numeral 62 denotes a data line for supplying the video signal data to the video data shift register of the information electrode drive circuit 13 from the transmitter 70, numeral 63 denotes a synchronization signal line for supplying the synchronization signal from the control circuit 61 to the transmitter 70, numeral 64 denotes a vertical synchronization signal line for supplying the vertical synchronization signal VD to the shift register of the scan electrode driver 12, and numeral 65 denotes a horizontal synchronization signal line for supplying the horizontal synchronization signal HD to the shift register of the scan electrode driver 12.

Numeral 66 denotes a video data register which stores data to be sent to the data line 62. Numeral 67 denotes a CPU which controls the video data register 66 and supplies the vertical synchronization signal VD and horizontal synchronization signal HD.

Figure 15:
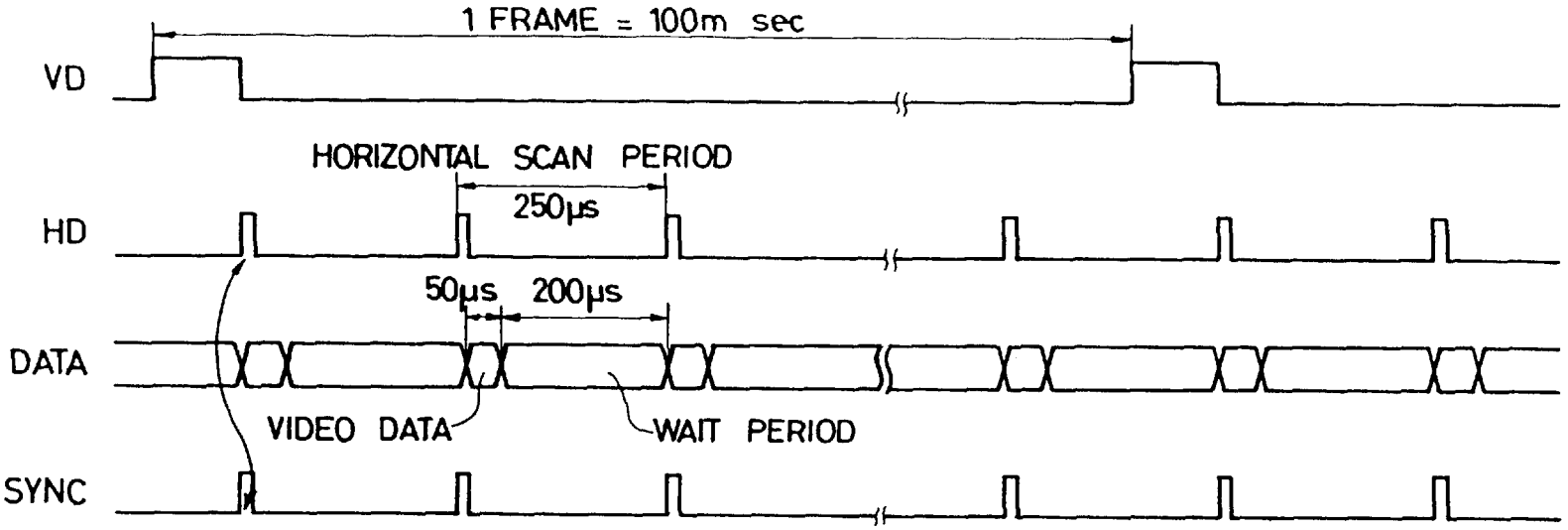
FIG. 15 shows a timing chart of one frame period to explain a signal communication method of the present invention.
Figure 16:
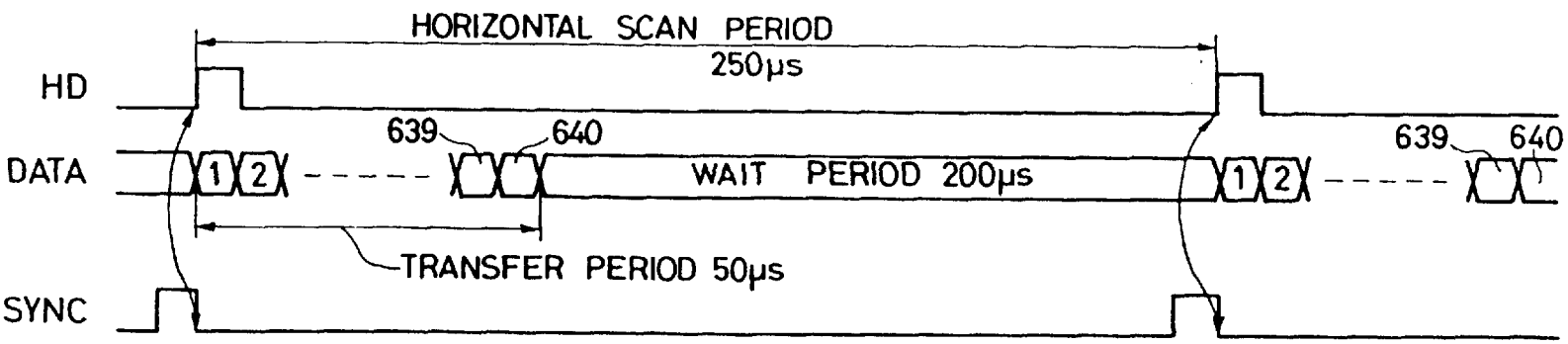
FIG. 16 shows a timing chart of one horizontal scan period in FIG. 2.

FIG. 15 shows a timing chart for one frame period of the signal communication method when the display panel is sequentially scanned, and FIG. 16 shows a timing chart for one horizontal scan period (1H) in FIG. 15.

In FIG. 15 and 16, the transmitter 70 supplies VD, HD and DATA and controls the output timing thereof by the synchronization signal SYNC generated by the controller 61 of the display 60. The period of SYNC is 250 $\mu$sec. which is equal to a period to write one scan line of data. The video DATA is transferred over 50 $\mu$ sec. and the remaining 200 $\mu$ sec. period is a wait time to the end of writing. After the wait time, the SYNC pulse is supplied from the controller 61 to the transmitter 70, and the transmitter 70 produces the HD pulse at the peak of the SYNC pulse and selects the next scan electrode and starts the transfer of DATA. The above operation is repeated 400 times which is equal to the number of scan electrodes SL to form one screen (frame).

In accordance with the present invention, when the write speed of the liquid crystal display device which uses the ferroelectric liquid crystal does not match to the transfer speed by the information signal, particularly when the former is slower than the latter, the synchronization signal SYNC is sent from the liquid crystal display device (which is the receiver) to the information signal output circuit which is the transmitter) so that the transmitter sends the information signal in accordance with the timing of the SYNC pulse and the display device and the information signal output circuit synchronize with each other to produce a normal image.

What is claimed is:

1. A driving and switching off circuit for a liquid crystal display device having a memory effect and a plurality of pixels, each pixel having the capability of exhibiting two states in accordance with an electric field applied thereto, said circuit comprising:

driving means for applying a drive signal to said display device to cause all of said pixels to uniformly exhibit one of said two states;

delay means for providing an end signal subsequent to the application of said drive signal; and means responsive to said delay means for switching off said display device subsequent to causing all the pixels to uniformly exhibit said one state.

2. A method for driving and switching off a liquid crystal display device having a memory effect and a plurality of pixels, each pixel having the capability of exhibiting two states in accordance with an electric field applied thereto, said method comprising the steps of:

generating a turn off signal to turn off said display device;

applying a drive signal, in response to said turn off signal, to said display device to cause all of said pixels to uniformly exhibit one of said two states;

providing an end signal subsequent to the application of said drive signal;

thereafter, in response to the end signal, switching off said display device subsequent to causing all the pixels to uniformly exhibit said one state.

3. A driving and switching off circuit for a liquid crystal display device having a memory effect and a plurality of pixels, each pixel having the capability of exhibiting two states in accordance with an electric field applied thereto, said circuit comprising:

driving means for applying a drive signal to said display device to cause all of said pixels to uniformly exhibit one of said two states;

delay means for providing a delay signal ending subsequent to the application of said drive signal; and means responsive to said delay means for switching off said display device subsequent to causing all the pixels to uniformly exhibit said one state.

4. A method for driving and switching off a liquid crystal display device having a memory effect and a plurality of pixels, each pixel having the capability of exhibiting two states in accordance with an electric field applied thereto, said method comprising the steps of:

generating a turn off signal to turn off said display device;

applying a drive signal, in response to said turn off signal, to said display device to cause all of said pixels to uniformly exhibit one of said two states;

delaying said turn off signal to provide a delayed turn off signal ending subsequent to the application of said drive signal; and thereafter, in response to the delayed turn off signal, switching off said display device.

* * * * *

UNITED STATES PATENT AND TRADEMARK OFFICE

CERTIFICATE OF CORRECTION

PATENT NO. : 5,952,990

DATED : September 14, 1999

INVENTOR(S): HIROSHI INOUE, ET AL.

It is certified that error appears in the above-identified patent and that said Letters Patent is hereby corrected as shown below:

COLUMN 1:

Line 57, "nal" should read --nal HD--.

COLUMN 3:

Line 22, "kairalsmechtic" (both occurrences) should read --chiral smectic--.
Line 23,"kairalsmechtic" should read --chiral smectic--.

COLUMN 5:

Line 2, "tuned" should read --turned--.
Line 61, "smechtic" should read --smectic--.
Line 64, "smechtic" should read --smectic--.

COLUMN 6:

Line 42, "register 13" should read --register 4--.

COLUMN 8:

Line 18, "decoder 22," should read --decoder 23,--.

UNITED STATES PATENT AND TRADEMARK OFFICE

CERTIFICATE OF CORRECTION

PATENT NO. : 5,952,990

DATED : September 14, 1999

INVENTOR(S): HIROSHI INOUE, ET AL.

It is certified that error appears in the above-identified patent and that said Letters Patent is hereby corrected as shown below:

COLUMN 9:

Line 23, "signal on" should read --signal ϕn--.
Line 47, "ddress" should read --address--.

COLUMN 11:

Line 29, "which" should read --(which--.

Signed and Sealed this

Twenty-second Day of August, 2000

*Attest:*

Q. TODD DICKINSON

*Attesting Officer*

*Director of Patents and Trademarks*